US009457329B2

(12) United States Patent
Akerstrom

(10) Patent No.: US 9,457,329 B2
(45) Date of Patent: Oct. 4, 2016

(54) ADJUSTABLE VOLUME MIXER CHAMBER AND METHOD OF USE

(75) Inventor: Patrik Akerstrom, Uppsala (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 551 days.

(21) Appl. No.: 13/700,194

(22) PCT Filed: May 30, 2011

(86) PCT No.: PCT/SE2011/050668

§ 371 (c)(1),
(2), (4) Date: Nov. 27, 2012

(87) PCT Pub. No.: WO2011/152781

PCT Pub. Date: Dec. 8, 2011

(65) Prior Publication Data

US 2013/0070555 A1 Mar. 21, 2013

(30) Foreign Application Priority Data

May 31, 2010 (SE) ..... 1050538

(51) Int. Cl.
*B01F 13/08* (2006.01)
*B01F 15/00* (2006.01)
*B01F 15/02* (2006.01)

(52) U.S. Cl.
CPC ..... *B01F 13/08* (2013.01); *B01F 13/0818* (2013.01); *B01F 15/00824* (2013.01); *B01F 15/0243* (2013.01); *B01F 2215/045* (2013.01); *B01F 2215/0431* (2013.01); *B01F 2215/0481* (2013.01)

(58) Field of Classification Search
CPC ..... B01F 13/08; B01F 13/0818
USPC ..... 366/273–274; 435/302.1
See application file for complete search history.

(56) References Cited

U.S. PATENT DOCUMENTS

| | | | | |
|---|---|---|---|---|
| 2,498,393 | A * | 2/1950 | Clewell | 366/274 |
| 2,631,091 | A * | 3/1953 | Kuentzel et al. | 422/105 |
| 2,661,938 | A * | 12/1953 | Kuentzel | 261/81 |
| 3,376,999 | A * | 4/1968 | De Hart et al. | 222/135 |
| 4,266,950 | A * | 5/1981 | Makino et al. | 261/93 |
| 4,808,348 | A | 2/1989 | Rudick et al. | |
| 5,708,313 | A * | 1/1998 | Bowes et al. | 310/90.5 |
| 6,048,496 | A * | 4/2000 | Zhou et al. | 422/70 |
| 6,620,326 | B1 | 9/2003 | Lihme et al. | |
| 7,178,451 | B2 * | 2/2007 | Crespi | F16J 15/3236 92/193 |
| 8,287,737 | B2 * | 10/2012 | Bielawski | F16J 15/166 210/198.2 |

(Continued)

*Primary Examiner* — David Sorkin
*Assistant Examiner* — Abbas Rashid
(74) *Attorney, Agent, or Firm* — Wood IP LLC

(57) ABSTRACT

The invention relates to a system and method for mixing two or more solutions. Provided is an integrated system for generating a homogeneous solution from two or more input solutions, comprising: a mixer chamber containing a magnetic stir bar; a means for rotating the magnetic stir bar; and an user interface for input a chosen flow rate. The mixer chamber comprises a mixer chamber body including a movable upper part which defines a mixer chamber volume; one or more solution inlets; an solution outlet; the magnetic stir bar; and a means for adjusting the mixer chamber volume. In response to the input flow rate, the mixing chamber volume is adjusted to an optimal volume, by the movement of the movable upper part, controlled by the means for adjusting the mixer chamber volume. Also provided are methods of using the system to achieve homogeneous mixing of two or more solutions.

5 Claims, 2 Drawing Sheets

(56) References Cited

U.S. PATENT DOCUMENTS

2003/0126914 A1* 7/2003 Hvidtfeldt et al. ..... 73/64.56
2006/0156918 A1* 7/2006 Dahl ..... G01N 30/6021 92/240
2007/0244429 A1* 10/2007 Nguyen et al. ..... 604/89
2008/0091176 A1* 4/2008 Alessi ..... A61K 9/0004 604/892.1
2013/0068095 A1* 3/2013 Johansson ..... F16J 1/008 92/208

* cited by examiner

ADJUSTABLE VOLUME MIXER CHAMBER AND METHOD OF USE

CROSS-REFERENCE TO RELATED APPLICATIONS

This application is a filing under 35 U.S.C. 371 of international application number PCT/SE2011/050668, filed May 30, 2011, published on Dec. 8, 2011 as WO 2011/152781, which claims priority to application number 1050538-6 filed in Sweden on May 31, 2010.

FIELD OF THE INVENTION

The present invention relates to a system and method for mixing two or more solutions or buffers. More specifically, the invention provided a system that contains a flexible mixer chamber the volume of which is adjusted in response to an input flow rate, as well as method of using the system to achieve homogeneous mixing of two or more buffers.

BACKGROUND OF THE INVENTION

Many biological and chemical applications require instant mixing of two or more buffers to generate a suitable solution. Normally different buffers are mixed in a mixer chamber, and transferred to one or more reaction containers after mixing. The ratio of input buffers is generally controlled by adjusting the incoming flow rate of the buffers.

While mixing of buffers is a somewhat standard process, current systems are incapable of offering a flexible solution. When the experimental needs call for a small amount of a solution, a small mixer chamber is desirable than a larger one, to reduce dead volume, it is also more cost effective since it reduces buffer waste. On the other hand, when a large amount of solution is needed, a small chamber would not be able to fulfill the job. For example, the ÄKTA™ systems have to use three different sized mixer chambers (i.e., 0.6 ml, 1.4 ml and 5 ml). The 0.6 ml mixer chamber shall be used if the required output flow rates <2 ml/min, the 1.4 ml one for flow rates between 2 and 12 ml/min, while the 5 ml one for flow rates between 12 and 25 ml/min. Thus the mixer chamber has to be swapped when the desired flow rate changes. Due to this complication, the mixer chamber can not be integrated to the mixer module (stirrer).

There is a need for an integrated mixer chamber design which adjusts the volume in response to an input flow rate. It is also desirable to simplify the mixer module design and improve the homogeneity of solution produced.

SUMMARY OF THE INVENTION

The present invention provides an integrated mixer chamber design which is capable of adjusting the volume in response to an input flow rate. Thus, one aspect of the invention provides an integrated system for generating a homogeneous solution from two or more input buffers. The system comprises a mixer chamber including a magnetic stir bar; a means for causing the magnetic stir bar to rotate; and a user interface for input a chosen flow rate. The mixer chamber (mixer house) comprises a mixer chamber body including a movable upper part; one or more solution inlets; a solution outlet; and a means for adjusting the mixer chamber volume. In response to an input flow rate, the mixing chamber volume is adjusted to an optimal volume, by the movement of the movable upper part, controlled by the means for adjusting the mixer chamber volume.

In another aspect of the invention, it is provided a method for generating a homogeneous solution from two or more input buffers. The method includes (a) accepting an user input flow rate; (b) converting the input flow rate to a desired mixer chamber volume; (c) moving the movable upper part of the mixer chamber to arrive at the desired mixer chamber volume; (d) starting, at the input flow rate, a first pumping means to direct the two or more input buffers into the mixer chamber; (e) causing the magnetic stir bar to rotate to mix the input buffers to generate a homogeneous solution; and (f) beginning, at the input flow rate, to release the homogeneous solution through the solution outlet.

DETAILED DESCRIPTION OF THE INVENTION

The invention provides a new mixer chamber design that adjusts its volume to an input flow rate by having a movable upper part. It is thus possible to use an optimized volume for any specific flow level within the capacity range of the mixer chamber. It is thus also possible to integrate the mixer chamber to a mixer module.

Thus, in a first aspect of the invention, it is provided a mixer chamber. In one embodiment, it is provided a mixer chamber (mixer house) comprising a mixer chamber body including a movable upper part which defines a mixer chamber volume; one or more inlets for solutions to be mixed in the mixer chamber; a solution outlet; a magnetic stir bar in the mixer chamber volume; and a means for adjusting the mixer chamber volume by controlling the movement of the movable upper part.

In certain embodiments, the one or more inlets of the mixer chamber are integral of the movable upper part. In certain embodiments, there is a single inlet which accepts two or more buffers for mixing. For example, the input and output pump tubing is connected with, for example Valco connection (UNF 10-32 2B) at inlet(s) and outlet.

In certain embodiments, the solution outlet of the mixer chamber is integral to the mixer chamber body and is on the oppose side of the movable upper part.

In certain embodiments, the mixer chamber included a means for adjusting the mixer chamber volume by controlling the movement of the movable upper part. Example of a means for adjusting the volume of the mixer chamber is a stepper motor (FIG. 1), DC motor with an encoder or a stepper motor with linear actuator. Thus, the correct mixer volume can be adjusted, in response of an input flow rate, by a motor and the user does not need to worry about the optimal mixer volume. It is thus possible to use an optimized volume for the specific flow level, for example between 0.6 and 5 ml, or any interval within the capacity of a mixer chamber.

Figure 1A:
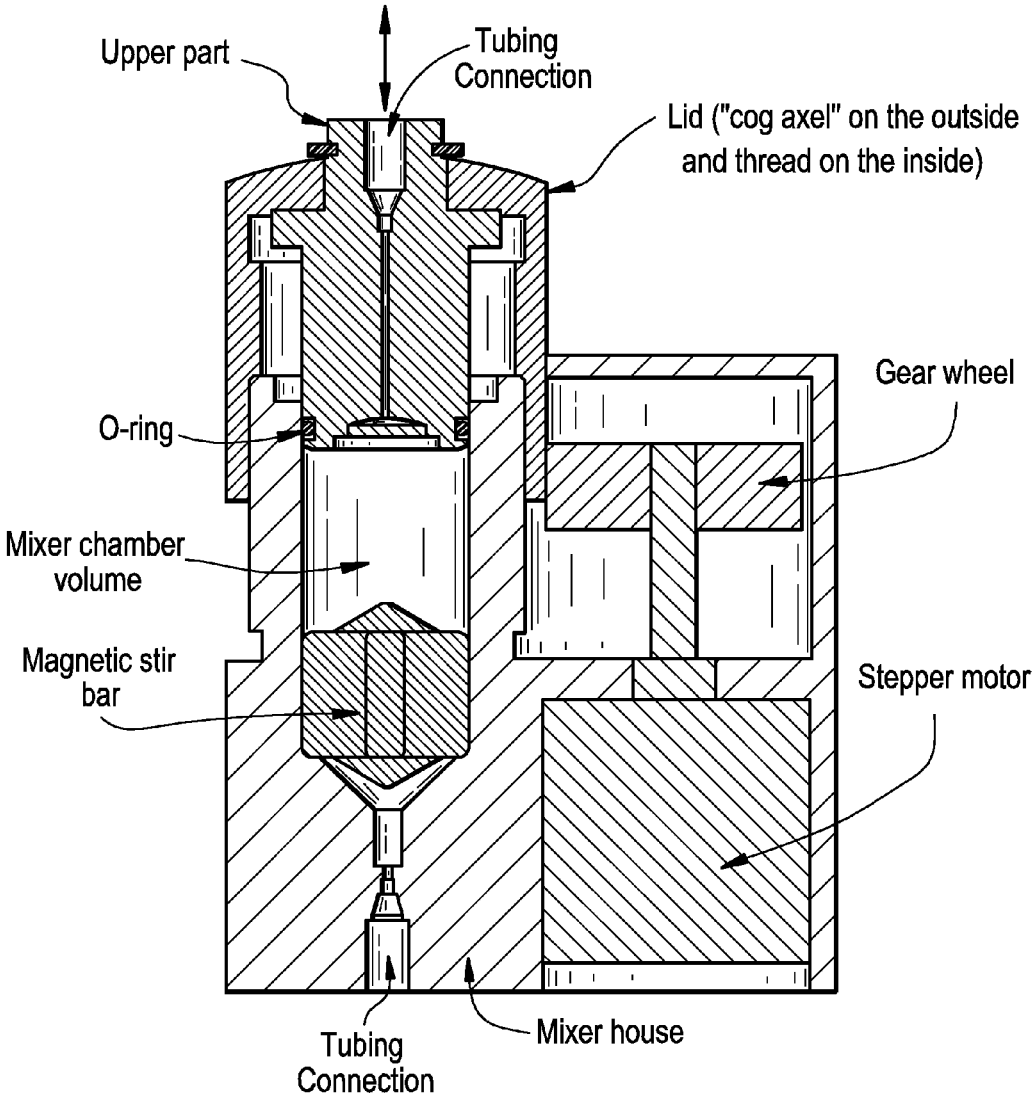
FIG. 1A is a schematic drawing of one example of a mixer chamber (mixer house) according to an embodiment of the invention.
Figure 1B:
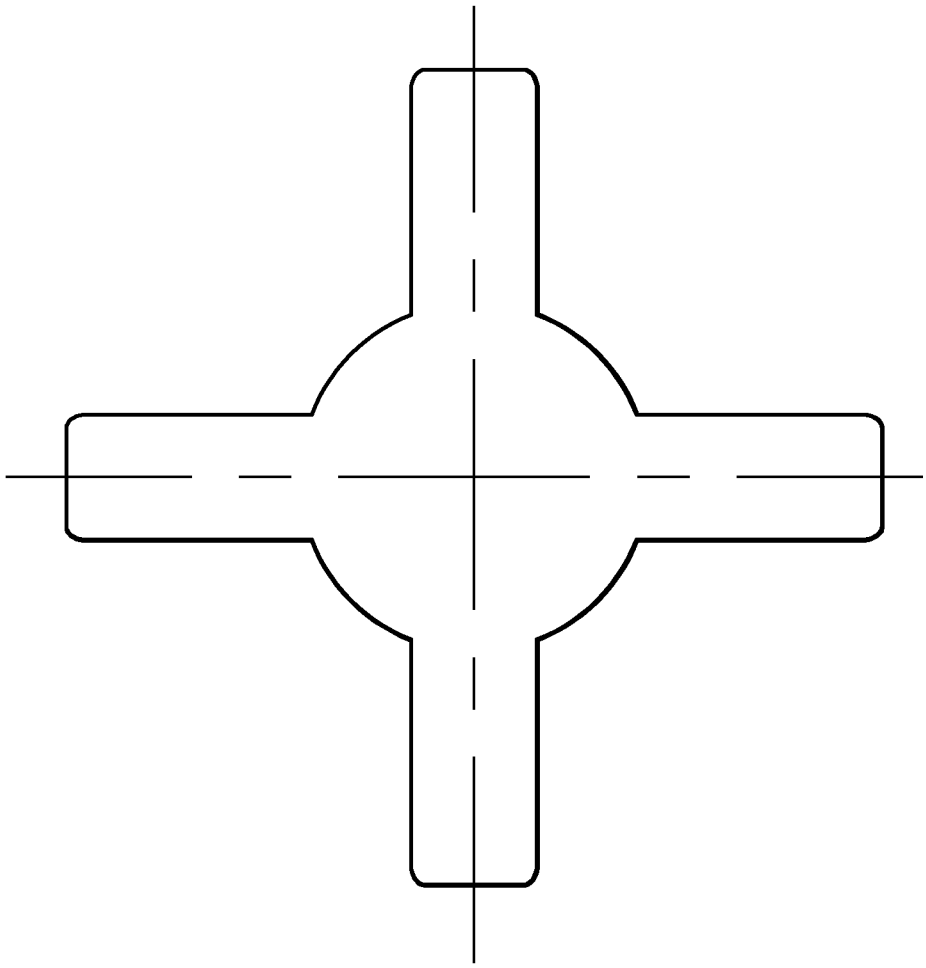
FIG. 1B is a top view of the magnetic stir bar used in the mixer chamber.

As illustrated in FIG. 1, when a desired volume is chosen, the exemplary stepper motor rotates and the rotating movement is transferred to the lid by outer shape that acts as a cog axel. The lid rotates and has a thread on the inside that creates a movement up or down. This makes the upper part of the mixer chamber to move up or down and therefore increases or decreases the mixer volume. Because of the friction in the o-ring is greater than the friction between the upper part and the lid, the upper part will not rotate, this minimizes wear of the o-ring (FIG. 1A) and does not twist the tubings.

In a second aspect of the invention, it is provided a mixer module. In certain embodiments, the mixer module comprises the mixer chamber according to the first aspect of the invention, and means for causing the magnetic stir bar to rotate. For example, the means for causing the magnetic stir bar to rotate is an outer rotating magnet.

In a third aspect of the invention, it is provided an integrated system for generating a homogeneous solution from two or more input buffers. In one embodiment, it is provided an integrated system for generating a homogeneous solution, which system includes the mixer module according to the second aspect of the invention and a user interface for input a chosen flow rate. In response to the input flow rate, the mixing chamber volume is adjusted to an optimal volume, by the movement of the movable upper part of the mixing chamber, controlled by the means for adjusting the mixer chamber volume.

In one variation of an embodiment, the means for adjusting the mixer chamber volume includes (1) means for converting the chosen flow rate to a desired mixer chamber volume; and (2) means for moving the movable upper part of the mixer chamber body to arrive at the desired mixer chamber volume. Optionally, the means for moving the movable upper part includes a motor connected to the moveable upper part of the mixer chamber body. A specific flow rate corresponds to a specific position of the upper part that gives the mixer volume. All flow rate/position of the upper part (mixer volume) ratios are listed in a table that are based on experimental data and/or calculations. The mixer volume can however be chosen by the operator to match a specific method and flow.

In a fourth aspect, the invention provides a method for generating a homogeneous solution from two or more input buffers. According to one embodiment, the method comprises: (a) accepting an user input flow rate; (b) converting the input flow rate to a desired mixer chamber volume; (c) moving the movable upper part of the mixer chamber (according to the first aspect of the invention) to arrive at the desired mixer chamber volume; (d) starting, at the input flow rate, a first pumping means to direct the two or more input buffers into the mixer chamber; (e) causing the magnetic stir bar to rotate to mix the input buffers to generate a homogeneous solution; and (f) beginning, at the input flow rate, to release the homogeneous solution through the solution outlet. In a variation, the flow rate in step (f) is controlled by a second pumping means.

Having described some general aspects of the invention, the following passages provide additional details of certain exemplary implementations of the invention.

The purpose of the mixer chamber (mixer house) design is to make sure that two or more input buffers are mixed to give a homogenous buffer composition (solution). Thus, a functioning mixing module consists of two parts, the mixer chamber (mixer house) and means for rotating the magnetic stir bar inside the mixer chamber. The means for rotating the magnetic stir bar contains certain electronics and the driving unit for rotating the magnetic stir bar.

As an example, the rotation of the magnetic stir bar is achieved by an outer rotating magnet. The rotation of this outer magnet, which is a permanent magnet, is controlled by a stepper motor. This is also used to control the rotation speed, which is varied based on the desired flow rate (i.e., volume). The driving unit has a nominal speed of 10 rev/sec and a maximum speed of 15 rev/sec. The outer rotating magnet and stepper motor can be placed outside the mixer chamber (mixer house), in a position adjacent to the magnetic stir bar inside the mixer chamber volume. Alternatively, they could be integrated to the mixer house, on the side of the mixer chamber volume, adjacent to the magnetic stir bar.

Optionally, the mixer module is activated by the pump module which controls the inflow of the two or more buffers.

As described above, the mixing process is performed in a mixing chamber with a magnetic stir bar. To obtain desired homogeneous gradients at different input flow rates, the mixer chamber volume is adjusted in response to the input flow rate. Two implementations are possible for such an adjustment. In one implementation, the volume adjustment can be performed to arrive at any volume corresponding to the input flow rate (i.e., calculation based on a formula for any input flow rate). Alternatively, several mixer chamber volumes can be preset, each for a flow rate range. For example, a mixer chamber volume of 0.6 ml, 1.4 ml and 5 ml can be chosen, for a flow rate range of 0.5-<3 ml/min, 3-<8 ml/min and 8-25 ml/min, respectively All patents, patent publications, and other published references mentioned herein are hereby incorporated by reference in their entireties as if each had been individually and specifically incorporated by reference herein. While preferred illustrative embodiments of the present invention are described, one skilled in the art will appreciate that the present invention can be practiced by other than the described embodiments, which are presented for purposes of illustration only and not by way of limitation. The present invention is limited only by the claims that follow.

What is claimed is:

1. A mixer chamber comprising:

a rotatable lid;

a mixer chamber body including a movable upper part which defines a mixer chamber volume through movement of the rotatable lid configured to translate about the mixer chamber body;

a sealing mechanism comprising an o-ring and configured to maintain a position of the upper part to move in a vertical direction during rotation of the rotatable lid by generating a frictional force between the upper part and the rotatable lid;

one or more inlets for solutions to be mixed in the mixer chamber;

a solution outlet;

a magnetic stir bar at least partially positioned within the mixer chamber volume; and an adjusting means configured to adjust the mixer chamber volume in response to a selected input flow rate by moving the rotatable lid and thus moving the movable upper part in the vertical direction.

2. The mixer chamber of claim 1, wherein the one or more inlets is integral of the movable upper part.

3. The mixer chamber of claim 1, wherein the outlet is integral of the mixer chamber body and is disposed on a surface of the mixing chamber body on an opposite side from where the movable upper part is disposed.

4. The mixer chamber of claim 1, wherein the frictional force is a first frictional force and a second frictional force exerted by the sealing means, and wherein the second frictional force is greater than the first frictional force.

5. The mixer chamber of claim 1, wherein the adjusting means adjusts the mixer chamber volume in response of an input flow rate into the one or more inlets.

* * * * *